US006098292A

United States Patent [19]

Harpell

[11] Patent Number: 6,098,292

[45] Date of Patent: Aug. 8, 2000

[54] DEMOLITION TOOL

[76] Inventor: William Harpell, 2380 Findlay Road, Joyceville, Ontario, Canada, K0H 1Y0

[21] Appl. No.: 09/037,342

[22] Filed: Mar. 10, 1998

[51] Int. Cl.[7] ..... A47L 13/02

[52] U.S. Cl. ..... 30/172; 30/169; 294/49; 294/54.5

[58] Field of Search ..... 30/167, 168, 169, 30/171, 172, 342, 344, 348; 294/54.5, 49, 55; D8/13, 14, 16, 19, 88

[56] References Cited

U.S. PATENT DOCUMENTS

| | | | |
|---|---|---|---|
| 1,191,810 | 7/1916 | Miller | 294/54.5 |
| 1,514,076 | 11/1924 | Brown | 294/54.5 |
| 1,898,234 | 2/1933 | Anderson | 294/54.5 |
| 4,086,699 | 5/1978 | Olkkola | 30/172 |
| 4,203,210 | 5/1980 | Hadlick, Jr. | 30/172 |
| 4,280,727 | 7/1981 | Germain | 294/54.5 |
| 5,280,676 | 1/1994 | Fieni | 30/172 |
| 5,558,379 | 9/1996 | Wehner | 294/49 |

FOREIGN PATENT DOCUMENTS

| | | | |
|---|---|---|---|
| 2006663 | 5/1979 | United Kingdom | 30/169 |

*Primary Examiner*—Hwei Siu Payer

[57] ABSTRACT

A tool having a flat, quadrangular shaped blade with a straight front edge and a parallel back edge, the front edge being tapered to provide a cutting edge. A handle receiving tube extends upwardly and rearwardly from the top of the blade, the tube being centered between the sides of the blade. At least one impact receiving member is on the tool positioned to allow the blade to be hammered in a direction to drive the blade forwardly to have the front edge of the blade cut through material. A groove is formed in the bottom surface of the blade, the groove being unshaped with the base of the groove parallel to the front edge of the blade and located in front of the handle receiving tube. The groove forms a strengthening ridge on the upper surface of the blade. A strengthening strap is fastened to the lower, front portion of the handle receiving tube and extends forwardly on the upper surface of the blade toward the front edge of the blade. Preferably, the front cutting edge of the blade is slotted to allow nail removal with the tool.

25 Claims, 6 Drawing Sheets

DEMOLITION TOOL

BACKGROUND OF THE INVENTION

1. Field of the Invention

This invention is directed toward an improved demolition tool. The invention is more particularly directed toward a tool of the type that is used to separate one layer or layers of material from a base by a wedging, cutting, action. Such a tool is particularly suited for removing old roofing, such as shingle roofing or built-up roofing.

2. Description of the Related Art

Often in removing roofing, particularly built-up, tarred, roofing, it is necessary to be able the cut the roofing to make it easier to remove. The usual roofing tool that has been previously employed is a square bladed shovel. The straight leading edge of the blade of the shovel is used to try to cut the roofing material being removed. It is often necessary to hammer the back of the blade of the shovel to drive the leading edge into the material to cut it. However, the back edge of the shovel blade is not very strong and often buckles under repeated hammer blows ruining the shovel for further work. Often, other tools must be employed, such as chisels or wedges, along with the shovel, to remove old roofing material.

The known shovels also are not constructed to withstand repeated impact when being driven in between layers of material and a base to separate the layers from the base such as when removing roofing material. The shovel blade often bends and/or the shovel fails where the handle receiving tube joins the blade.

SUMMARY OF THE INVENTION

It is the purpose of the present invention to provide an improved tool of the type adapted to be driven between layers of material and a base to separate the layers of material from the base such as when removing roofing material. The tool has impact receiving means allowing it to be hammered, if required, during use to aid in separating and cutting the material layers. It is another purpose of the present invention to provide an improved tool of the type that is driven between layers of material and a base to separate the layers from the base which tool is strengthened in construction. It is another purpose of the present invention to provide an improved tool that more easily separates layers of material from a base by camming the layers from the base. It is a further purpose of the present invention to provide a tool for separating layers of material from a base that can also be used to remove any headed fastening means holding the layers to the base. The improved tools are particularly useful for removing roofing material.

In accordance with the present invention there is provided a tool having a flat blade with a straight front cutting edge and impact receiving means on the tool which can be hammered to drive the cutting edge of the blade in between layers of material and a support base, in a direction generally parallel to the layers, to separate the layers from the base. The impact receiving means can also be hammered to drive the cutting edge in a direction perpendicular to the layers of material to cut the layers of material if required. The impact receiving means can be in the form of a thickened rear edge of the blade, or in the form of blocks on the top of the blade. The blocks could be shaped to help cam the material layers being separated apart from the base in accordance with the present invention, there is also provided a tool having a strengthened blade. The blade can be strengthened by forming a groove in the bottom surface of the blade which groove ridges the top surface of the blade thereby strengthening it. The blade can also be strengthened by applying a strap that extends over the lower part of the handle receiving tube on the blade and over the top surface of the blade as well, the strap extending toward the front edge of the blade. Both the ridge and the strap are positioned to help the tool cam or wedge the layers from the base. Preferably, the strengthened blade is used in combination with the impact receiving means on the tool to provide a more complete tool. The tool with the flat blade, and the impact receiving means on the tool, can also be provided with one or more slots extending inwardly from the front cutting edge to define a plurality of cutting teeth. The slots are sized and shaped to allow the tool to easily lift nails remaining as the layers of material are separated and removed.

The invention is particularly directed toward a tool having a flat, quadrangular shaped blade with a straight front edge and a parallel back edge, the front edge being tapered to provide a cutting edge. A handle receiving tube extends upwardly and rearwardly from the top of the blade, the tube being centered between the sides of the blade. Impact receiving means are on the tool, the impact receiving means positioned to allow the blade to be hammered in a direction to drive the blade forwardly to have the front edge of the blade cut through material.

The invention is also particularly directed a tool having a flat, quadrangular shaped blade with a straight front edge and a parallel back edge, the front edge being tapered to provide a cutting edge. A handle receiving tube extends upwardly and rearwardly from the top of the blade, the tube being centered between the sides of the blade. A groove is formed in the bottom surface of the blade, the groove being unshaped with the base of the groove parallel to the front edge of the blade and located in front of the handle receiving means. The legs of the groove, on either side of the handle receiving means, are about midway between the sides of the blade and the handle receiving means. The groove forms a strengthening ridge on the upper surface of the blade.

The invention is further particularly directed toward a tool having a flat, quadrangular shaped blade with a straight front edge and a parallel back edge, the front edge being tapered to provide a cutting edge. A handle receiving tube extends upwardly and rearwardly from the top of the blade, the tube being centered between the sides of the blade. A strengthening strap is fastened to the lower, front portion of the handle receiving means and extends forwardly on the upper surface of the blade toward the front edge of the blade.

DESCRIPTION OF THE PREFERRED EMBODIMENTS

Figure 1:
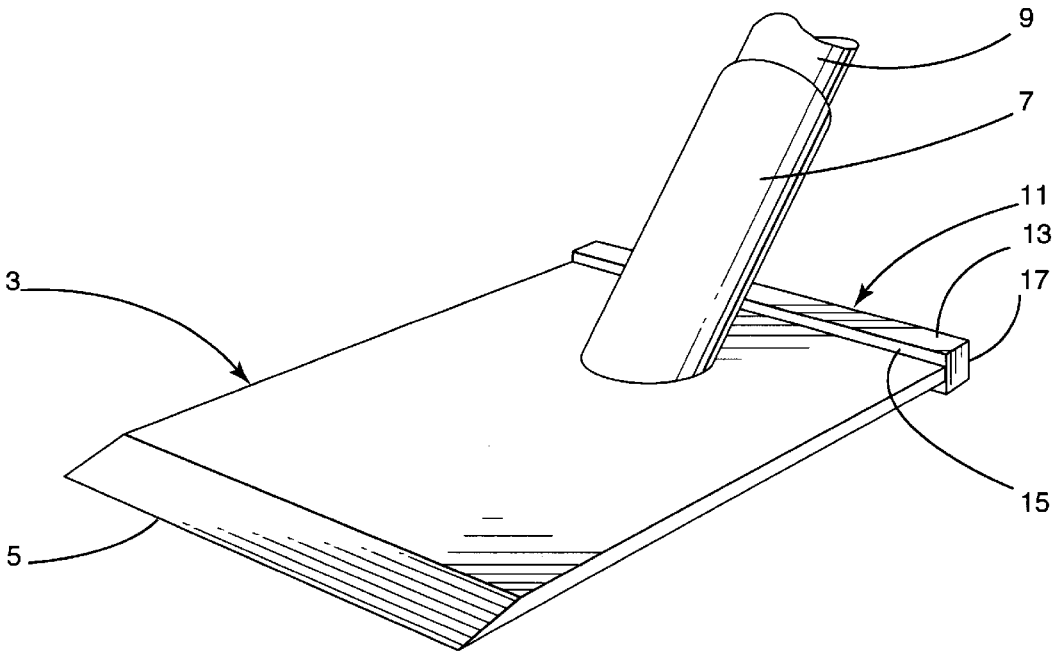
FIG. 1 is a perspective view of the tool.
Figure 2:
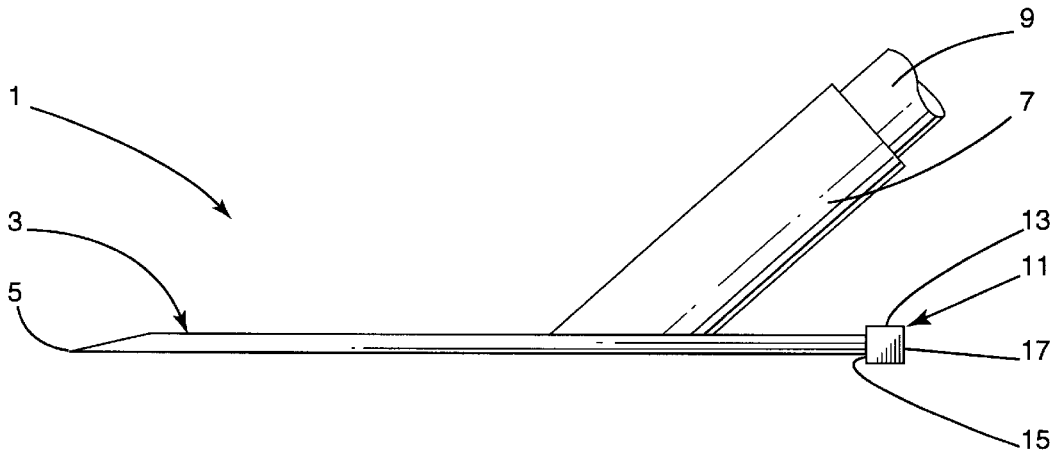
FIG. 2 is a side view of the tool.

The improved tool 1, as shown in FIGS. 1 and 2, has a flat quadrangular blade 3 with a tapered, straight, front cutting edge 5. A handle receiving tube 7 extends upwardly and rearwardly from the rear portion of the blade 3. A handle 9 is fixed in the tube 7. Impact receiving means 11 are provided on the tool 1 so the impact receiving means 11 can be hammered in a direction to force the cutting edge 5 of the blade 3 forwardly to cut through material or obstructions. As shown in FIGS. 1 and 2, the impact receiving means 11 can comprise a rod member 13, substantially thicker than the blade 3, fastened, as by welding, to the back edge 15 of the blade. The rod member 13 is parallel to the front edge 5 of the blade, preferably extends across the width of the blade 3, and preferably is square in cross-sectional shape, as shown, although it could also have a round or rectangular cross-section. The blade 3 is centrally located relative to the rod member 13 as seen in FIG. 2 so impact on the back side 17 of the rod member is centered on the blade 3 to force the cutting edge 5 forwardly.

When the tool 1 is used to remove old roofing material, such as shingles, from a roof, the blade 3 of the tool is driven in between the shingles and the roof, in a direction generally parallel to the shingles and roof, using the handle 9 of the tool. If an obstruction, such as one or more roofing nails, is encountered, the blade 3 of the tool can be driven forward to cut through the obstruction by hammering on the back side 17 of the rod 13 at the back of the blade 3. Sometimes it may be necessary to transversely cut through the layers of material being removed and in this case, the tool can be placed with the blade 3 transverse to the material with the cutting edge 5 abutting the material and the blade driven to cut through the material by hammering on the back 17 of the rod 13 on the back edge 15 of the blade 3.

Figure 3:
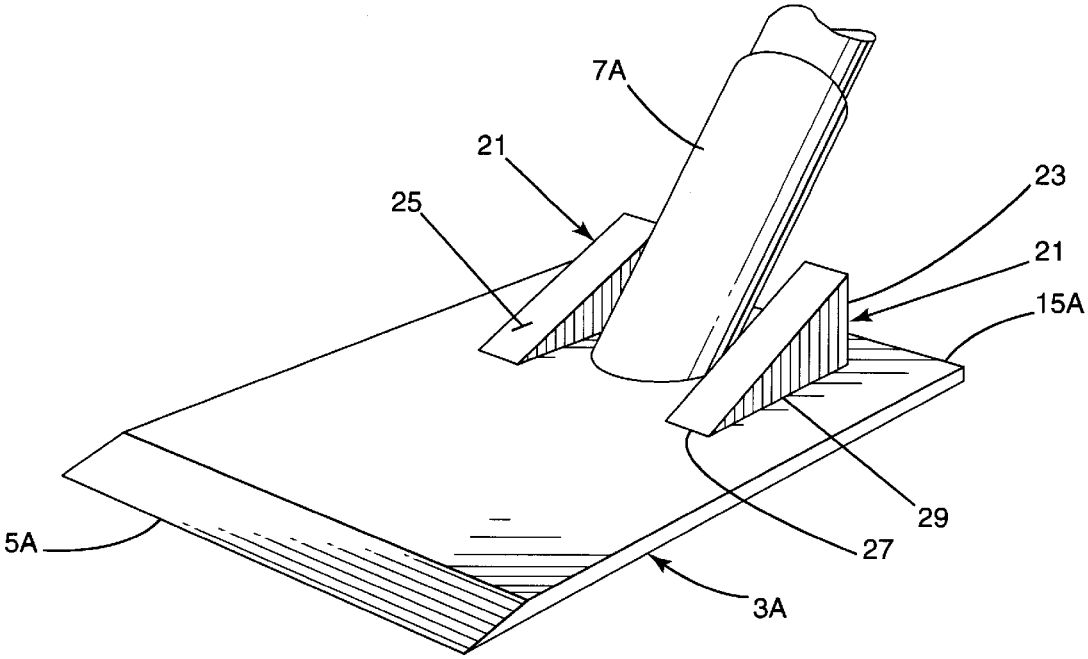
FIG. 3 is a perspective view of another embodiment of the tool.
Figure 4:
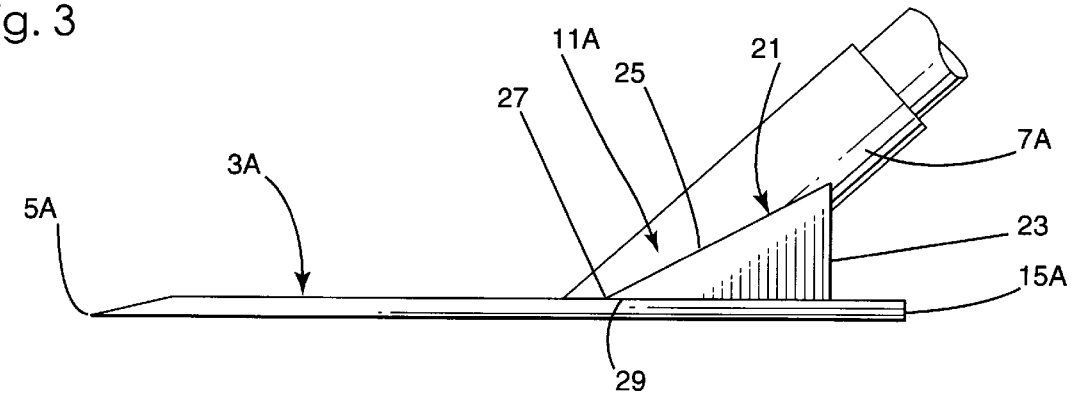
FIG. 4 is a side view of the tool shown in FIG. 3.

The impact receiving means 11 on the tool 1 can take other forms. As shown in FIGS. 3 and 4, the impact receiving means 11A can comprised a pair of blocks 21 mounted on the upper surface of the blade 3A, one on either side of the handle receiving means 7A. Each block 21 has a vertical back surface 23 facing the rear edge 15A of the blade 3A, the back surface 23 forming an impact receiving surface. The blocks 21 are hammered, usually alternatively, on the back surfaces 23 to force the cutting edge 5A of the blade 3A forwardly to cut through any obstruction or material. Each block 21 can be right-triangular in shape, as shown, with the hypotenuse, or sloping surface 25 extending upwardly and rearwardly from the front edge 27 of the block 21 to the back surface 23. The bottom surface 29 of the block is welded on the top surface of the blade 3A. The blocks 21 are positioned on the blade 3A to have a major portion of the sloping surface 25 located in front of the handle receiving tube 7A. This allows the sloping surface 25 to cam roofing material upwardly away from a roof during use of the tool, the material riding up on the sloping surfaces 25 of the blocks 21.

Figure 5:
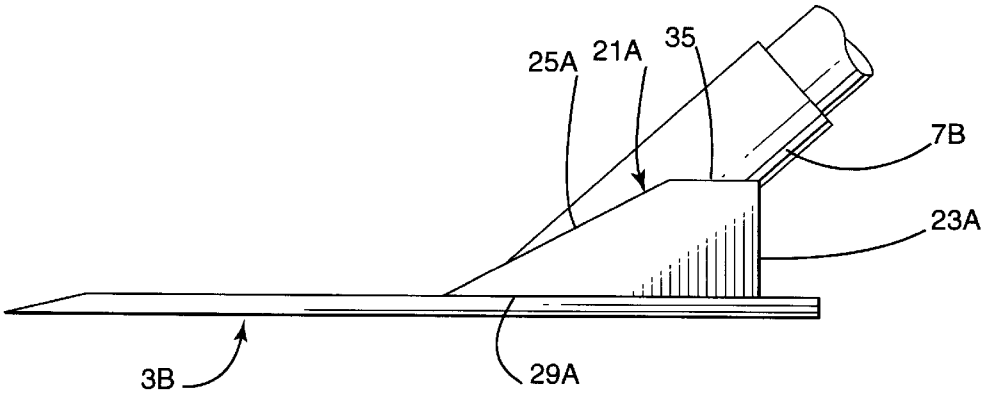
FIG. 5 is a side view, similar to FIG. 4, showing a modification of the tool.

If needed, the blocks 21A, as shown in FIG. 5, could be lengthened to have a trapezoid shape with an angled front surface 25A, a horizontal top surface 35, a vertical back surface 23A and a bottom surface 29A joining the angled front surface 25A and the back surface 23A. These extended blocks 21A position the camming front surfaces 25A forwardly in front of the handle receiving tube 7B while locating the impact receiving back surfaces 23A rearwardly of the tube 7B to make hammering easier.

Figure 6:
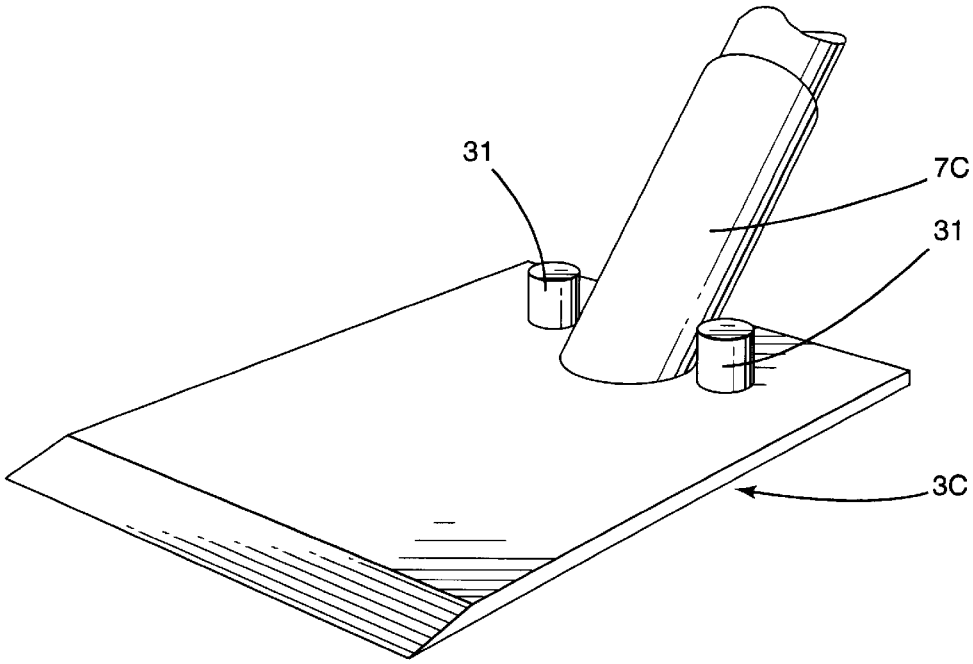
FIG. 6 is a perspective view showing another modification of the tool.

The impact receiving means can also comprise short lengths of rods or pins 31 welded in an upright position on the top of the blade 3C adjacent either side of the handle receiving tube 7C as shown in FIG. 6. The rods or pins 31 can be circular or square in cross-section.

Figure 7:
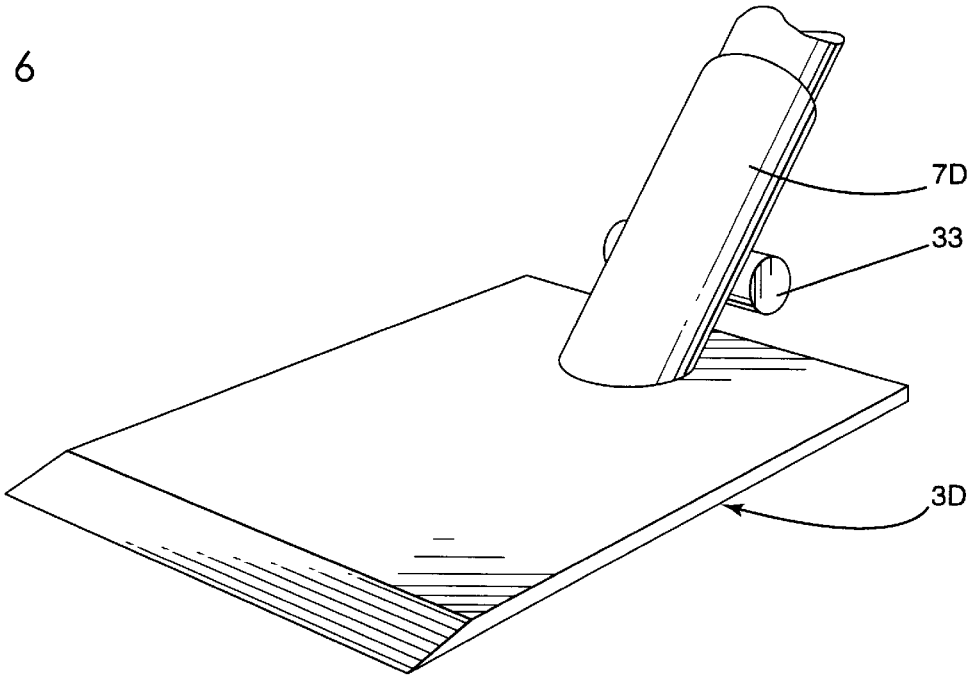
FIG. 7 is a perspective view, similar to FIG. 6, showing still another modification of the tool.

In another embodiment, the impact receiving means can be in the form of a short length of rod or pin 33 welded to the back of the handle receiving tube 7D just above the blade 3D as shown in FIG. 7. The rod or pin 33 extends transversely across the back of the handle receiving tube 7D, parallel to the front cutting edge 5D.

Figure 8:
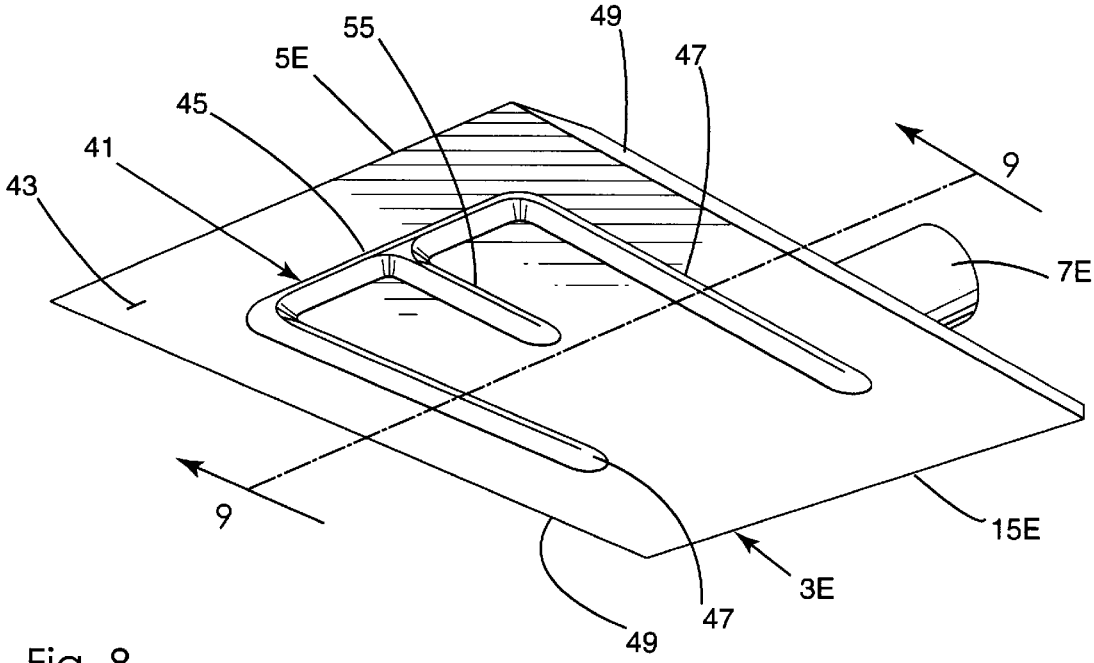
FIG. 8 is a bottom perspective view showing a strengthened tool.
Figure 9:
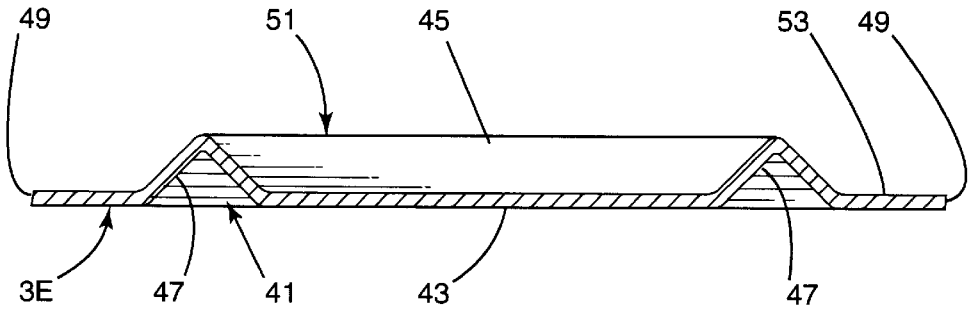
FIG. 9 is a cross section view taken along line 9—9 of FIG. 8.

Since the tools shown in FIGS. 1 to 7 are often hammered to cut through obstructions or layers of material, it is preferred that these tool embodiments be strengthened to prevent premature failure. This can be done in one embodiment by providing strengthening means on the blade of a tool which has impact receiving means of the type shown in FIGS. 1, 2 and 7. The strengthening means can be in the form of a groove 41 formed in the bottom surface 43 of the blade 3E as shown in FIGS. 8 and 9. The groove 41 is in the form of a "U" with the base leg 45 close to the front edge 5E of the blade 3E and the side legs 47 parallel to the sides 49 of the blade 3E with each side leg 47 spaced about midway between a side 49 and the handle receiving tube 7E. The groove 41 forms a raised rib or ridge 51 on the upper surface 53 of the blade 3E which rib stiffens the blade making it stronger. If desired, the groove 41 can include a central leg 55 running from the center of the base leg 45 toward the handle receiving tube 7E. The strengthened tool could, in easier work situations, be used without impact receiving means similar to rod member 13 or rod 33 if desired, the blade 3E being hammered on the back edge 15E if hammering is needed.

Figure 10:
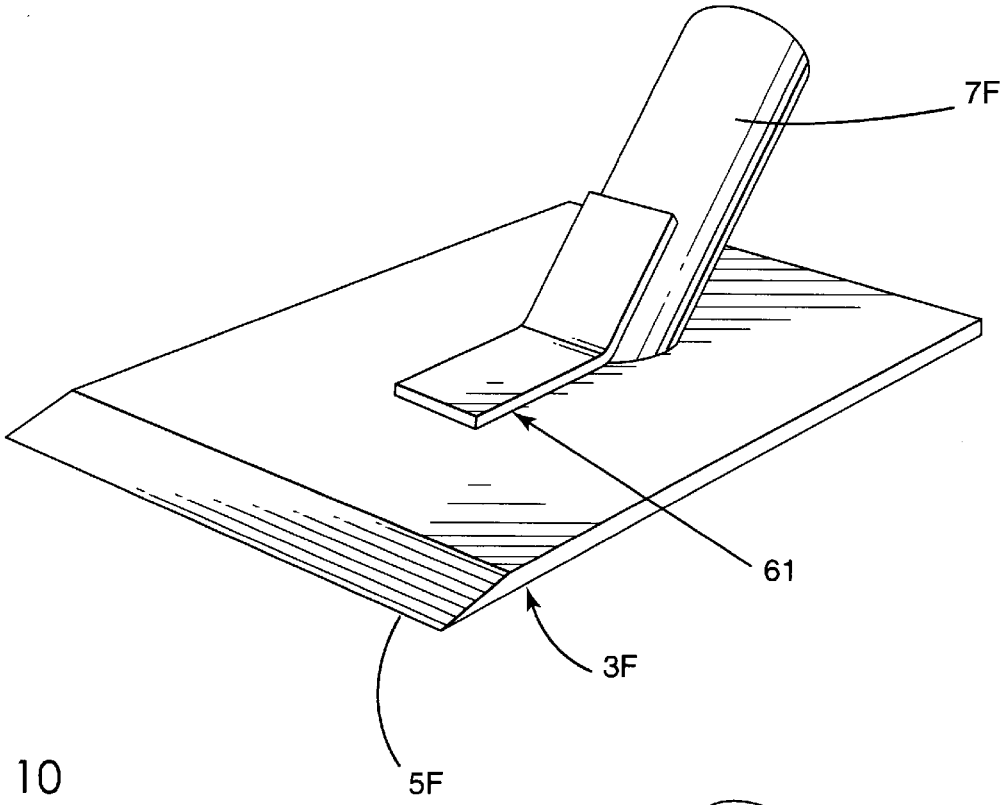
FIG. 10 is a perspective view of another embodiment of a strengthened tool.

The tool, of the type shown in FIGS. 1 to 7, could also be strengthened by fastening, as by welding, a strap 61 over the lower front portion of the handle receiving tube 7F and the central portion of the blade 3F extending toward, but not reaching the front edge 5F of the blade as shown in FIG. 10. The strap 61 would strengthen the joint between the tube 7F and the blade 3F and would also serve to upwardly cam the material being removed. The strap can be used in conjunction with the unshaped strength groove 41 in the tools shown in FIGS. 1, 2 and 7 to provide an extremely strong tool. The tool could also be used without any impact receiving means in some very easier work situations where the back edge of the blade could be hammered and the strap would help cam the material being removed upwardly.

Figure 11:
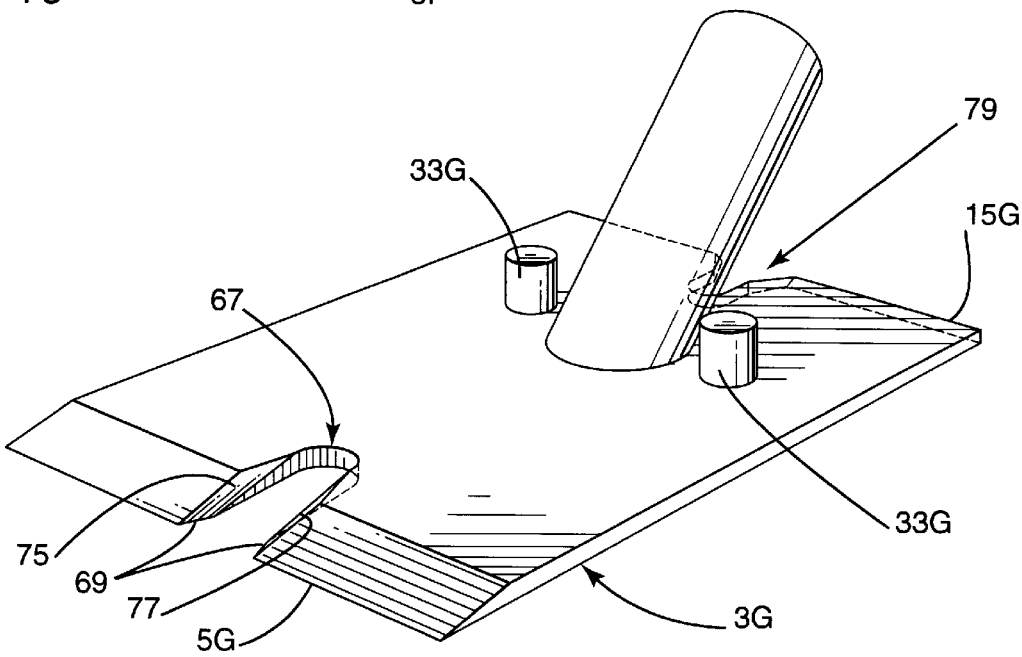
FIG. 11 is a perspective view of yet another embodiment of the tool modified to remove fasteners.
Figure 12:
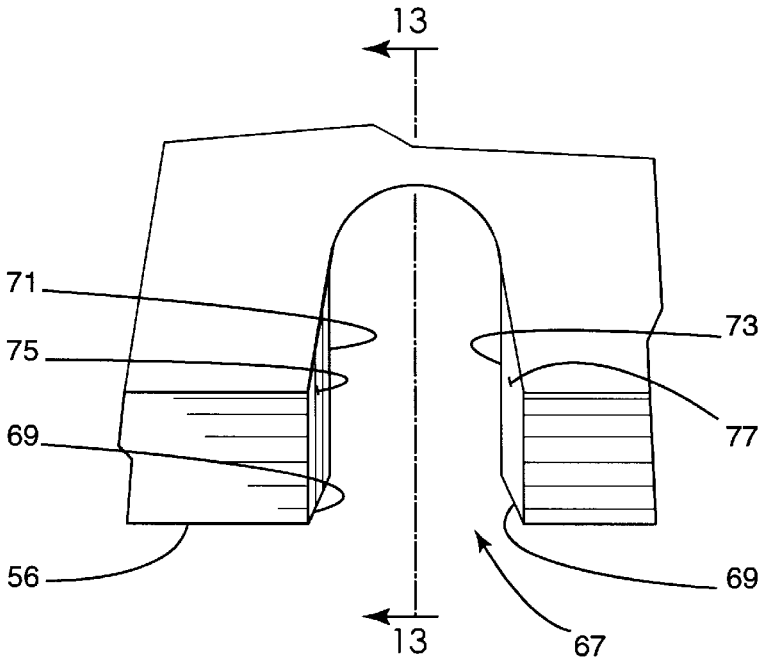
FIG. 12 is a detail plan view of the slot in the front edge of the tool shown in FIG. 11.
Figure 13:
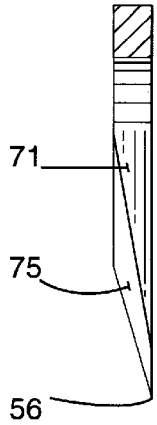
FIG. 13 is a detail cross-section view taken along line 13—13 in FIG. 12.

If desired, any of the blades of the tools shown in FIGS. 1 to 10 can have a single front slot 67, as shown in FIGS. 11 to 13, extending rearwardly from the front cutting edge 5G of the blade 3G and centrally located therein, to remove any nails from the surface being worked on. The slot 67 has a tapered entrance 69 to guide the nail into the slot and parallel side edges 71, 73. The side edges 71, 73 are tapered from the front to the back to increase in thickness from front to back. This allows the side edges to easily cam the nail upwardly via its head riding up on the tapered sides, as it slides into the slot 67. The nail is then more easily removed when the blade is tilted up upwardly. The tapered side edges 71, 73 are formed by beveling the blade adjacent the slot 67 as shown at 75, 77. The width of the slot is made to accommodate the size of nails normally found in the environment the tool is to be used in. Any blade provided with a front slot 67 has impact receiving means thereon as shown by the pins 33G by way of example.

The rear portion of the blades of the tools shown in FIGS. 3 to 10, with front cutting edges, and with or without a single front slot therein, can be provided with one or more slots 79 extending forwardly from the rear edge 15G of the blade as shown in FIG. 11. These slots 79 are also used for removing nails from the surface being worked on. The rear slot, or slots, 79 are formed similarly to slot 67 with a tapered entrance and tapered, parallel side edges. Any of the blades, with one or more rear slots, are also provided with impact receiving means thereon.

Figure 14:
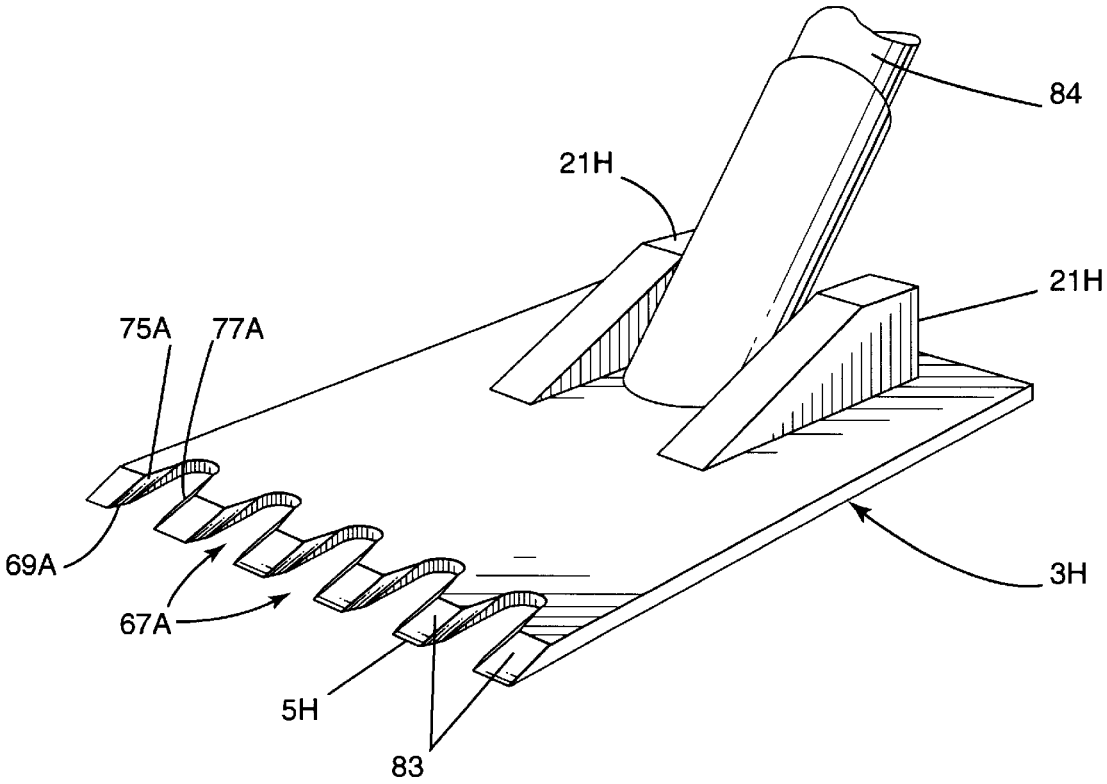
FIG. 14 is a persppective view of another embodiment of the tool modified to remove fasteners.

Any of the blades of the tools shown in FIGS. 1 to 10 could have a plurality of slots in the front cutting edge. As shown in FIG. 14, the blade 3H has a plurality of slots 67A in the front cutting edge 5H forming a plurality of cutting teeth 83. The slots 67A are each similar to slot 67 and have a tapered entrance 69A and tapered, parallel side edges formed by beveling the blade adjacent the slot as shown at 75A, 77A. Any blade with a plurality of front slots 67A, such as blade 3H, are provided with impact receiving means thereon. FIG. 14 shows the impact receiving means in the form of trapezoid shaped blocks 21H. One or more slots, not shown, similar to slots 67A, could be provided on the back edge of the blade as well where the location of the impact receiving means permits it. This tool, with a plurality of front slots and impact receiving means thereon, is normally provided with a short handle 84, which extends at an angle of between twenty five and forty five degrees to the blade, and preferably at about thirty five degrees. The tool is very useful in demolition work, particularly interior demolition work involving the removal of moldings and casings and the like. The tool can be hammered under moldings and casing, and used as a pry, to separate them from the base they are attached to. Any nails left in the base are easily removed.

The various tool embodiments have been mainly described for use in removing old roofing material. The tools however can be used in many environments. The tools, with a flat blade, could for example be used in removing tiles or linoleum flooring. The same tools, again with a flat blade, could also be used for removing ice from sidewalks or driveways. The tools could be used in gardening where plants or trees have to be removed or transplanted and roots require cutting. the tools can be used in any environment where a blade is used to separate layers of material and the blade must occasionally be hammered to help separate and/or cut the layers of material.

I claim:

1. A tool having a flat, quadrangular shaped blade with a front edge and a parallel back edge, the front edge being tapered to provide a cutting edge, a handle receiving tube extending upwardly and rearwardly from a top surface of the blade, the tube being centered between opposed sides of the blade, and impact receiving means on the tool, the impact receiving means allowing the tool to be hammered in a direction to drive the blade forwardly to have the front edge of the blade cut through material.

2. A tool as claimed in claim 1 wherein the impact receiving means comprises a rod fastened to the back edge of the blade, the rod extending parallel to the back edge of the blade and generally centered, as seen from both a top and a side elevation view of the blade, with respect to the back edge of the blade.

3. A tool as claimed in claim 2 including a strengthening groove formed in the bottom surface of the blade, the groove being u-shaped with the base of the groove parallel to the front edge of the blade and located in front of the handle receiving tube and the legs of the groove on either side of the handle receiving tube about midway between the sides of the blade and the handle receiving tube.

4. A tool as claimed in claim 3 including a strengthening strap fastened to the lower front portion of the handle receiving tube and extending forwardly on the upper surface of the blade toward the front edge of the blade.

5. A tool as claimed in claim 2 wherein the blade has a nail receiving slot extending rearwardly from the front edge of the blade, the slot have a tapered opening leading to a narrow slot with parallel walls, the sides of the slot tapered from thin at the front to thick at the back to cam the nail head upwardly it moves back into the slot.

6. A tool as claimed in claim 2 wherein the blade has a plurality of nail receiving slots extending rearwardly from the front edge of the blade, each slot having a tapered entrance and parallel sides, the sides of the slot tapered from thin at the front to thick at the back to cam the nail head upwardly as it moves back into the slot.

7. A tool as claimed in claim 1 wherein the impact receiving means comprises a pair of blocks, one on each side of the handle receiving tube, fastened to the top surface of the blade, each block having an impact receiving surface facing the back of the blade, transverse to the blade.

8. A tool as claimed in claim 7 wherein the blocks have an angled front surface extending upwardly and rearwardly from the bottom surface of the block, the front surface positioned in front of the handle receiving tube and acting to cam material upwardly that is loosened by the tool.

9. A tool as claimed in claim 8 wherein the blocks have a side view in the shape of a right angled triangle.

10. A tool as claimed in claim 8 wherein the blade has a plurality of nail receiving slots extending rearwardly from the front edge of the blade, each slot having a tapered entrance and parallel sides, the sides of the slot tapered from thin at the front to thick at the back to cam the nail head upwardly as it moves back into the slot.

11. A tool as claimed in claim 7 including a strengthening groove formed in the bottom surface of the blade, the groove being u-shaped with the base of the groove parallel to the front edge of the blade and located in front of the handle receiving tube and the legs of the groove on either side of the handle receiving tube about midway between the sides of the blade and the handle receiving tube.

12. A tool as claimed in claim 11 including a strengthening strap fastened to the lower front portion of the handle receiving tube and extending forwardly on the upper surface of the blade toward the front edge of the blade.

13. A tool as claimed in claim 7 wherein the blade has a nail receiving slot extending rearwardly from the front edge of the blade, the slot have a tapered opening leading to a narrow slot with parallel walls, the sides of the slot tapered from thin at the front to thick at the back to cam the nail head upwardly it moves back into the slot.

14. A tool as claimed in claim 7 wherein th blade has plurality of nail receiving slots extending rearwardly from the front edge of the blade, each slot having a tapered entrance and parallel sides, the sides of the slot tapered from thin at the front to thick at the back to cam the nail head upwardly as it moves back into the slot.

15. A tool as claimed in claim 1 wherein the impact receiving means comprise a pair of short pins on the top surface of the blade, one on each side of the handle receiving tube, the pins extending upwardly from the blade.

16. A tool as claimed in claim 1 wherein the impact receiving means comprise a short pin fastened to the back of the handle receiving tube, the pin extending transversely across the handle receiving tube and located close to, but spaced from, the blade.

17. A tool as claimed in claim 1 including a strengthening groove formed in the bottom surface of the blade, the groove being u-shaped with the base of the groove parallel to the front edge of the blade and located in front of the handle receiving tube and the legs of the groove on either side of the handle receiving means about midway between the sides of the blade and the handle receiving tube.

18. A tool as claimed in claim 17 including a strengthening strap fastened to the lower front portion of the handle receiving tube and extending forwardly on the upper surface of the blade toward the front edge of the blade.

19. A tool as claimed in claim 1 including a strengthening strap fastened to the lower front portion of the handle receiving tube and extending forwardly on the upper surface of the blade toward the front edge of the blade.

20. A tool as claimed in claim 1 wherein the blade has a nail receiving slot extending rearwardly from the front edge of the blade, the slot have a tapered opening leading to a narrow slot with parallel walls, the sides of the slot tapered from thin at the front to thick at the back to cam the nail head upwardly it moves back into the slot.

21. A tool as claimed in claim 1 wherein the blade has a plurality of nail receiving slots extending rearwardly from the front edge of the blade, each slot have a tapered opening leading to a narrow slot with parallel walls, the sides of the slot tapered from thin at the front to thick at the back to cam the nail head upwardly it moves back into the slot.

22. A tool having a flat, quadrangular shaped blade with a front edge and a parallel back edge, the front edge being tapered to provide a cutting edge, a handle receiving tube extending upwardly and rearwardly from a top surface of the blade, the tube being centered between opposed sides of the blade, a strengthening groove formed in a bottom surface of the blade, the groove being u-shaped having one transverse base leg and two side legs, said transverse base leg being parallel to, and near but spaced from, the front edge of the blade and located in front of the handle receiving tube and the side legs of the groove on either side of the handle receiving tube about midway between the sides of the blade and the handle receiving tube, a ridge formed on the top surface of the blade by the base leg of the groove helping cam material upwardly when the front edge of the blade is forced under the material.

23. A tool as claimed in claim 22 including a strengthening strap fastened to the lower front portion of the handle receiving tube and extending forwardly on the top surface of the blade toward the front edge of the blade.

24. A tool as claimed in claim 22 wherein the blade has a nail receiving slot extending rearwardly from the front edge of the blade, the slot have a tapered opening leading to a narrow slot with parallel walls, the sides of the slot tapered from thin at the front to thick at the back to cam the nail head upwardly it moves back into the slot.

25. A tool as claimed in claim 22 wherein the blade has a plurality of nail receiving slots extending rearwardly from the front edge of the blade, each slot having a tapered entrance and parallel sides, the sides of the slot tapered from thin at the front to thick at the back to cam the nail head upwardly as it moves back into the slot.

* * * * *